US010843888B2

(12) United States Patent
Dim et al.

(10) Patent No.: US 10,843,888 B2
(45) Date of Patent: Nov. 24, 2020

(54) TRANSPORTING SHEETS OF PRINT MEDIA

(71) Applicant: HP SCITEX LTD., Netanya (IL)

(72) Inventors: Yuval Dim, Moshav Haniel (IL); Alex Veis, Kadima (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/994,349

(22) Filed: May 31, 2018

(65) Prior Publication Data

US 2019/0010006 A1 Jan. 10, 2019

(30) Foreign Application Priority Data

Jul. 10, 2017 (EP) ..... 17180609

(51) Int. Cl.

| | |
|---|---|
| ***B65H 29/34*** | (2006.01) |
| ***B41J 11/00*** | (2006.01) |
| ***B65H 29/52*** | (2006.01) |
| ***B65H 29/16*** | (2006.01) |
| ***B65H 5/02*** | (2006.01) |
| ***B65H 29/24*** | (2006.01) |
| ***B65H 5/22*** | (2006.01) |

(52) U.S. Cl.

CPC ..... *B65H 29/34* (2013.01); *B41J 11/007* (2013.01); *B65H 5/021* (2013.01); *B65H 5/224* (2013.01); *B65H 29/16* (2013.01); *B65H 29/242* (2013.01); *B65H 29/52* (2013.01); *B65H 2301/312* (2013.01); *B65H 2301/4461* (2013.01); *B65H 2301/517* (2013.01); *B65H 2404/153* (2013.01); *B65H 2404/268* (2013.01); *B65H 2404/61* (2013.01); *B65H 2701/1762* (2013.01); *B65H 2801/15* (2013.01)

(58) Field of Classification Search

CPC ..... B65H 29/34; B65H 29/16; B65H 29/52; B65H 29/60; B65H 29/26; B65H 29/36; B65H 29/32; B65H 29/246; B41J 11/007

USPC ..... 198/603, 435

See application file for complete search history.

(56) References Cited

U.S. PATENT DOCUMENTS

| | | | | |
|---|---|---|---|---|
| 1,497,438 A * | 6/1924 | Gottschalk | ..... | C06F 1/08 198/462.3 |
| 2,604,972 A * | 7/1952 | Schmied | ..... | B65G 47/31 198/462.2 |
| 2,799,384 A * | 7/1957 | Rutherford | ..... | A21B 3/07 198/560 |

(Continued)

FOREIGN PATENT DOCUMENTS

| | | |
|---|---|---|
| DE | 19929316 | 12/2000 |
| DE | 10215920 | 11/2003 |

(Continued)

*Primary Examiner* — Thomas A Morrison

(74) *Attorney, Agent, or Firm* — Dicke Billig & Czaja PLLC

(57) ABSTRACT

Certain examples described herein relate to transporting sheets of print media. In one example, a media transport apparatus has a plurality of media transport sections including a first media transport section and a second media transport section offset from the first media transport section in a media transport direction. The media transport apparatus has a holding section arranged to receive a sheet of print media from the first media transport section. The holding section is moveable to deposit the sheet of print media upon the second media transport section.

7 Claims, 4 Drawing Sheets

(56) References Cited

U.S. PATENT DOCUMENTS 3,185,286 A * 5/1965 Koplin ..... D06B 3/30 198/434
4,235,434 A * 11/1980 Muller ..... B65H 1/22 271/280
4,541,824 A * 9/1985 Muller ..... B65H 5/28 198/371.2
4,867,299 A * 9/1989 Fukuoka ..... B65G 47/643 198/435
4,966,521 A * 10/1990 Frye ..... B65H 29/68 271/183
5,360,316 A * 11/1994 O'Mara ..... B07C 1/04 198/530
5,562,032 A 10/1996 Hasegawa et al.
5,779,432 A * 7/1998 Pena ..... B65G 57/11 198/418.6
7,052,006 B2 * 5/2006 Stauber ..... B65H 33/04 270/58.31
7,222,941 B2 5/2007 Silverbrook et al.
7,383,016 B2 6/2008 Lee et al.
7,434,677 B2 * 10/2008 Ritchie ..... A22C 21/0053 198/406
7,722,180 B2 * 5/2010 Mashima ..... B41J 3/60 209/584
8,292,061 B2 * 10/2012 Iwasa ..... B65B 5/061 198/407
8,783,850 B2 7/2014 Stephens et al.
8,857,813 B1 10/2014 Piatt
9,028,894 B2 * 5/2015 Olejarski ..... A23G 4/02 426/3
9,505,208 B2 11/2016 Shmaiser et al.
9,643,400 B2 5/2017 Landa et al.
2002/0012036 A1 1/2002 Dante
2006/0180032 A1 8/2006 Ritchie et al.
2007/0008394 A1 1/2007 Mashima
2010/0109235 A1 5/2010 Sugiyama et al.
2010/0170196 A1 7/2010 Iwasa
2014/0035217 A1 2/2014 Soga

FOREIGN PATENT DOCUMENTS

EP 0150655 8/1985
EP 1847397 10/2007
JP 5-77963 * 3/1993
WO WO-2015013096 1/2015
WO WO-2016083408 6/2016

* cited by examiner

TRANSPORTING SHEETS OF PRINT MEDIA

BACKGROUND

Digital printing presses deposit printing fluid onto print media. The print media may be supplied in the form of sheets, such as sheets of corrugated cardboard for packaging. Printing fluids for deposit may comprise inks, primers, fixing agents, glosses and varnishes, amongst others. Certain printing fluids may be deposited on top of other printing fluids, e.g. inks over fixing agents or varnishes over inks. Before printing fluids can be deposited on top of other printing fluids, they may need to dry and/or undergo particular chemical reactions or interactions. Similarly, sheets may not be stacked and/or otherwise handled until printing fluids are dry. This can conflict with the desire for high throughput from the printing press. For example, modern printing presses may operate at speeds of up to several meters per second.

BRIEF DESCRIPTION OF THE DRAWINGS

Various features of the present disclosure will be apparent from the detailed description which follows, taken in conjunction with the accompanying drawings, which together illustrate features of certain examples, and wherein.

DETAILED DESCRIPTION

Certain examples described herein provide a way to transport media within a printing press. In examples, media transport sections are arranged to transport sheets of print media onto holding sections. In these holding sections a sheet of media may be held for a configurable time period before being deposited onto a further media transport section. By stacking rows of media transport sections and holding sections in a direction perpendicular to a plane of the sheet of print media, a time delay may be introduced into the media transport system of the printing press that allows printing fluids to dry. These examples thus enable throughput to be balanced against drying time without a large footprint. They also enable a significant reduction in the energy used to dry printing fluids.

Figure 1A:
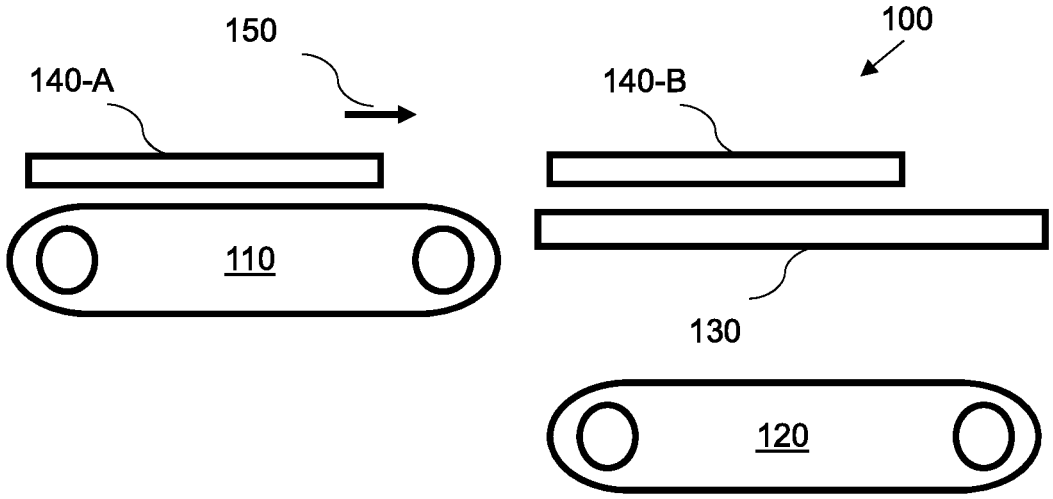
FIG. 1A is a schematic diagram showing a side view of a media transport apparatus at a first time according to an example.

FIG. 1A shows a media transport apparatus 100 comprising a plurality of media transport sections, in the form of a first media transport section 110 and a second media transport section 120, and a holding section 130. The media transport sections 110, 120 may be implemented by a variety of different media transport technologies, e.g. may comprise a belt conveyor system or set of rollers. The media transport sections 110, 120 are arranged to transport sheets of print media 140. The sheets of print media may comprise sheets of paper, polymer, corrugated media, card and/or fabric, amongst other materials. The media transport sections 110, 120 may comprise vacuum systems to retain sheets of print media upon an upper surface, such as a belt or conveyor. As shown in FIG. 1, the second media transport section 120 is offset from the first media transport section 110 in a media transport direction 150. In FIG. 1A, the media transport direction 150 is left to right, and thus the second media transport section 120 is horizontally-spaced to the right of the first media transport section 110. The media transport direction 150 is set by the first media transport section 110.

The holding section 130 is aligned with the first media transport section 110 so as to receive a sheet of print media 140-B from the first media transport section 110, e.g. as the sheet of print media 140-B moves in the media transport direction 150. In FIG. 1A, the holding section 130 is horizontally aligned with the first media transport section 110. The holding section 130 is arranged above the second media transport section 120, i.e. is vertically aligned with the second media transport section 120.

Figure 1B:
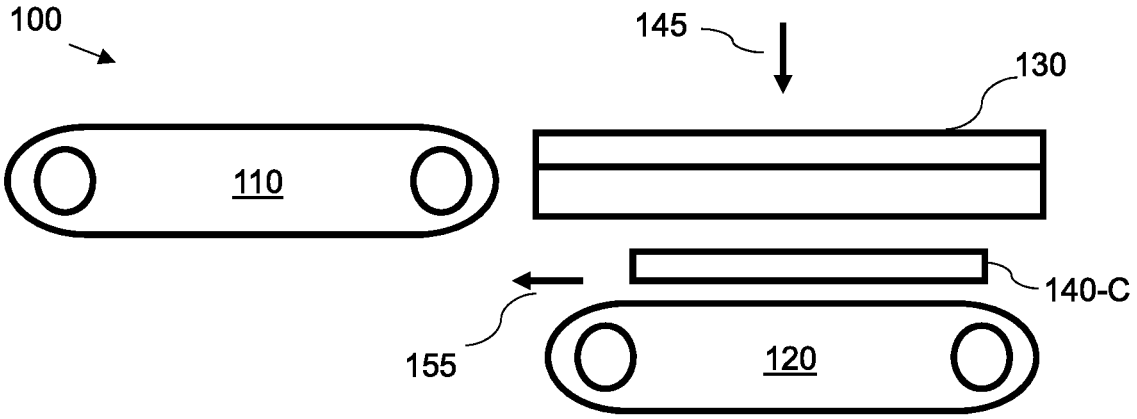
FIG. 1B is a schematic diagram showing a side view of the media transport apparatus of FIG. 1A at a second time.

FIG. 1B shows how the holding section 130 is moveable to deposit a sheet of print media 140-C upon the second media transport section 120. In FIG. 1B, the holding section 130 is actuated, which causes the sheet of print media 140-C to drop under gravity in direction 145 onto the second media transport section 120. In certain cases, the drop can be accelerated by air flow and/or air suction. The holding section 130 may be activated by pivoting or laterally moving supporting elements of the holding section 130. These supporting elements may thus move and no longer support the sheet of print media. In FIG. 1B, the second media transport section 120 has a media transport direction 155 that is opposite to the media transport direction 150 imparted by the first media transport section 110. In other examples, the media transport direction 155 may be the same as the media transport direction 150.

Figure 1C:
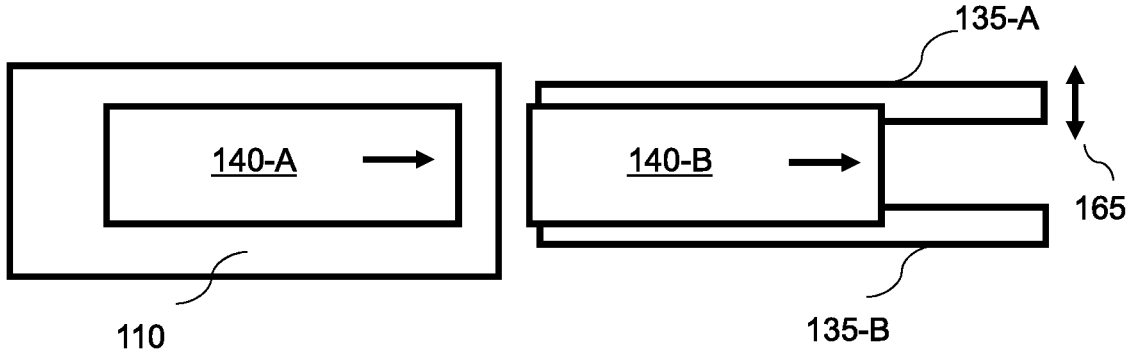
FIG. 1C is a schematic diagram showing a top view of an implementation of the media transport apparatus of FIG. 1A.

FIG. 1C shows a possible implementation of the media transport apparatus 100 of FIG. 1A from above. In operation, the media transport apparatus 100 receives sheets of media 140 and the first media transport section 110 transports the sheets of media 140 onto the holding section 130. The holding section 130 in FIG. 1C comprises two supporting elements 135-A and 135-B. These supporting elements 135-A and 135-B may comprise a set of laterally spaced bars or rods that extend in the media transport direction 150. At least one of the supporting elements 135 may be laterally moveable so as to accommodate different sizes of print media, such as different sheet widths, as in indicated by arrow 165. In FIG. 1C, at least supporting element 135-A is moveable in a direction perpendicular to the media transport direction 150 in a plane parallel with the sheet of print media 140-B. For example, sheets of widths from 0.5 m to 1.5 m may be accommodated by adjusting the lateral spacing of the supporting elements 135. In other examples, the holding section may alternatively comprise at least one platform or shelf that is pivotable or laterally moveable so as to deposit a sheet of print media upon the second media transport section 120. For example, a linear drive system may move a support element from under the sheet of print media (e.g. upwards and downwards from the perspective of FIG. 1C).

In FIG. 1C, the sheet of print media 140-B is supported upon respective surfaces of the plurality of laterally-spaced supporting elements. These may be an upper surface of a bar or rod, or a planar member. One method of actuating the supporting elements 135 is to rotate at least one of said elements to deposit the sheet of print media upon the second media transport section 120. For example, if a support surface of the supporting elements is cantilevered from a pivotable axis, rotation of the surface about that axis may rotate the surface such that it lies beyond the edge of the sheet of print media, enabling the sheet to fall between the supporting elements onto the second media transport section 120. Rotation may be actuated using one or more motors. The speed and frequency of actuation may be programmed based on a known conveyance speed of the sheets of print media.

In certain examples, sheets of media may be accelerated prior to receipt upon media transport section 110 so as to introduce controllable spacing between sheets of print media. In other examples, there may be little or no spacing between the sheets, wherein the time taken to actuate the holding section 130 and reset to the position of FIG. 1A is controlled such that the holding section 130 is able to receive and support the next sheet of print media (e.g. sheet 140-A in FIG. 1A).

In certain examples, the media transport apparatus further comprises an air supply that directs an air flow onto the second media transport section 120. For example, an air flow may be directed diagonally downwards onto the upper surface on the second media transport section 120, e.g. below the right-hand edge of the holding section 130 in FIG. 1A. An air flow can assist the falling of the sheet of print media, e.g. providing a force to increase the speed at which the sheet falls onto the second media transport section 120. This may be beneficial to allow the holding section 130 to be actuated and reset before a next sheet of print media arrives.

The arrangement showed in FIG. 1A compresses the length of the media transport in direction 150, e.g. the horizontal direction in FIG. 1A, by offsetting and stacking media transport sections 110, 120 in a direction substantially perpendicular to the planes of the sheets of print media 140, e.g. the vertical direction in FIG. 1A. Thus the horizontal footprint of the media transport apparatus 100 is reduced, while the holding section 130 delays the passage of a sheet of print media through the apparatus and thus provides increased drying time for printing fluids. These printing fluids may comprise inks, primers, fixing agents, glosses and varnishes, amongst others.

In a comparative example having a continuous media transport, e.g. a continuous horizontal conveyor unit, a printing press may run at speeds of between ~1-3 $ms^{-1}$. If a particular printing fluids takes 15 s to dry, at an operating speed of 2 $ms^{-1}$, this comparative example may have a conveyor 30 m in length. However, certain examples described herein enable drying times of up to 15 s with much reduce horizontal lengths, by effectively folding the media transport in the vertical dimension. At operating speeds of 2 $ms^{-1}$, a sheet of length 0.7 m will be received by the first media transport section 110 every 0.35 s. As such, the actuation of the holding section 130 is on the order of fractions of a second. The examples described herein further avoid contact with the upper surface of a sheet of print media, which may be wet and cannot be handled while drying.

Figure 2:
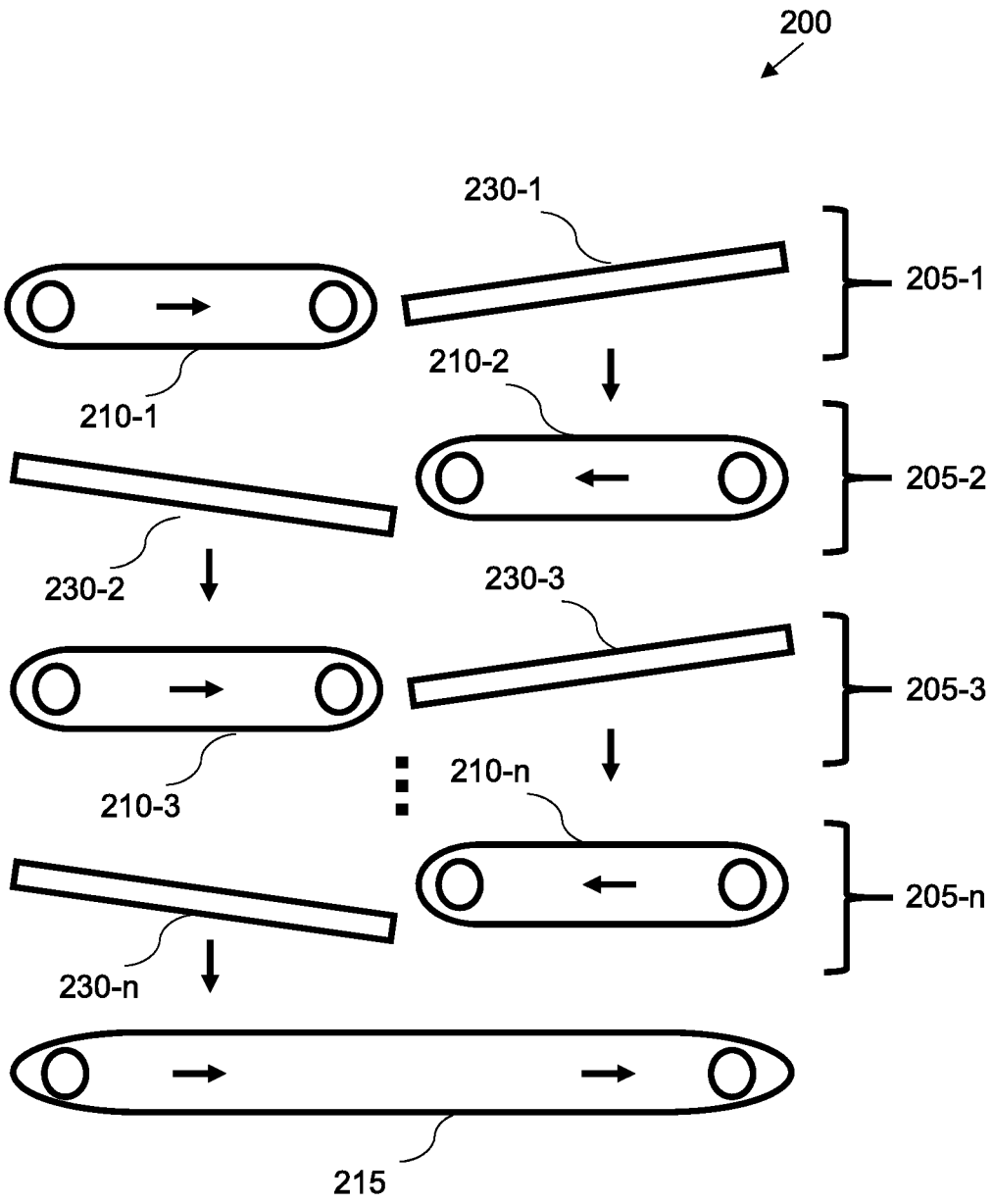
FIG. 2 is a schematic diagram showing a side view of a printing press according to an example.

FIG. 2 is a schematic diagram showing a side view of a printing press 200 according to an example. This printing press 200 is an extension of the media transport apparatus 100 shown in FIGS. 1A, B and C. The printing press 200 may be configured to handle sheets of corrugated media, such as cardboard for packaging. The printing press 200 comprises a plurality of media transport tiers 205. Each media transport tier comprises a conveyance unit 210 and a set of holding bars 230 aligned in a direction of media transport for the tier. For example, with reference to FIG. 1A, a media transport tier may be implemented using the first media transport section 110 and the holding section 130. In FIG. 2, the holding bars 230 are angled (slanting upwards from left to right). Holding bars 230 may be angled in the manner shown in the Figure, i.e. sloping upwards in the direction of travel of the tier, or in another manner, e.g. sloping downwards in the direction of travel of the tier, or may not be angled.

In FIG. 2, there are n media transport tiers. In each tier, a direction of media transport is reversed, e.g. as compared to the tier above or below. A sheet of print media thus travels through the printing press as indicated by the arrows of the Figure. In other examples, this may not be the case, for example, an arrangement may be stepped from left to right or from right to left. In FIG. 2, the plurality of media transport tiers 205 are spaced in a direction perpendicular to planes of media transport, i.e. in a vertical direction. Each set of holding bars 230 are arranged to receive a sheet of corrugated media from a respective conveyance unit and to hold the sheet for a period of time. The holding bars 230 of each tier, apart from the last tier 205-*n*, are moveable to deposit a received sheet of corrugated media onto a conveyance unit of a lower media transport tier. The holding bars 230 of the last tier 205-*n* are moveable to deposit a received sheet of corrugated media onto an unloading conveyance unit 215, which extends along the length of the tiers. Depending on the vertical space available, additional tiers may be added to further extend a drying period.

In certain printing presses, a dryer unit is used to dry printing fluid on a sheet of print media. In these cases, the arrangement of FIG. 1A or FIG. 2 may transport a sheet of print media to a dryer unit, e.g. from the second media transport section 120 or the unloading conveyance unit 215. By using the arrangements of FIG. 1A or FIG. 2 to introduce a delay into the transport of print media, an amount of energy used for drying printing fluid may be reduced considerable. For example, introducing a delay of 40 s with the arrangement of FIG. 2 may reduce the power used for drying the sheets of print media from 300 KW to 50 KW (i.e. by a factor of 6).

Figure 3A:
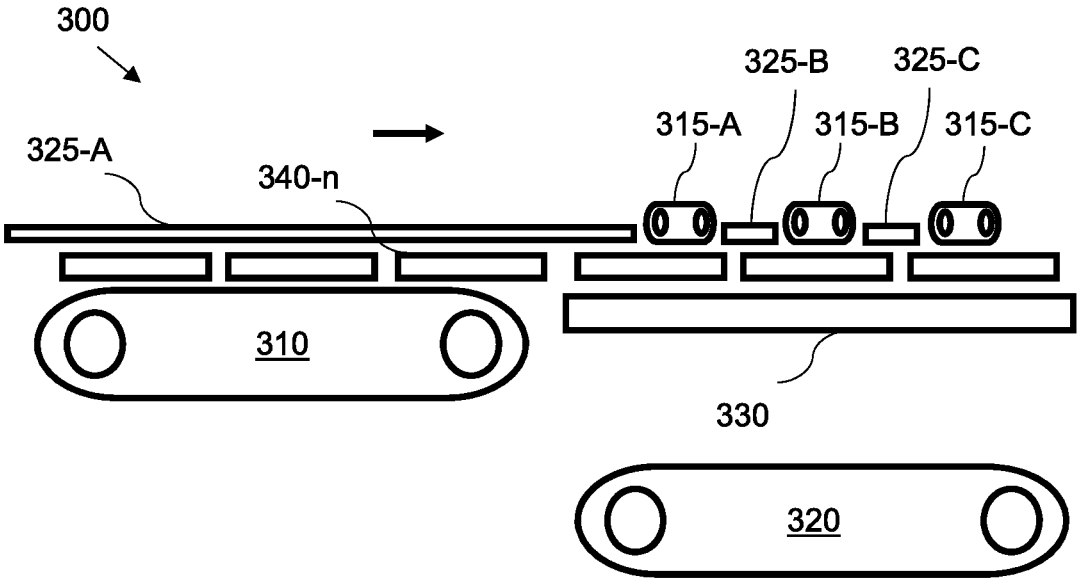
FIG. 3A is a schematic diagram showing a side view of a media transport apparatus at a first time according to another example.
Figure 3B:
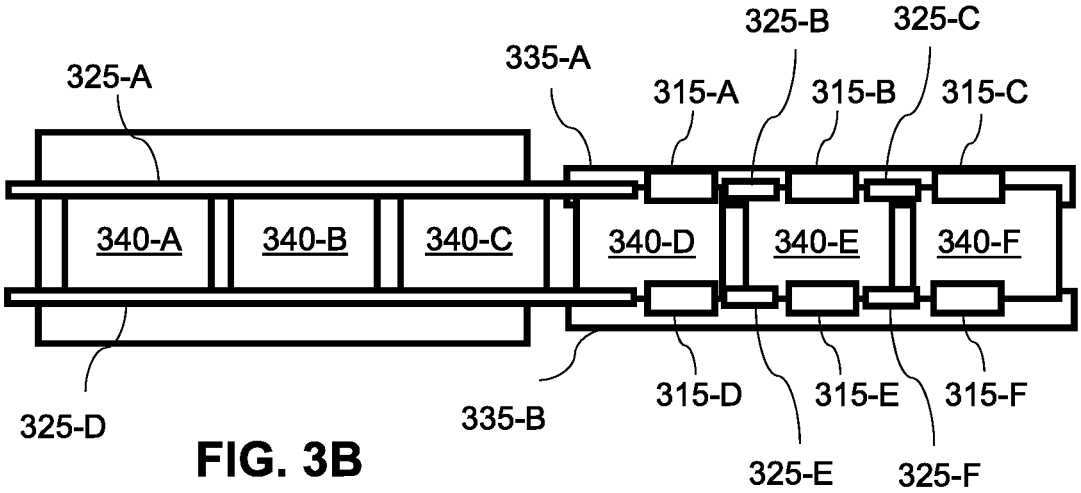
FIG. 3B is a schematic diagram showing a top view of the media transport apparatus of FIG. 3A at the first time.
Figure 3C:
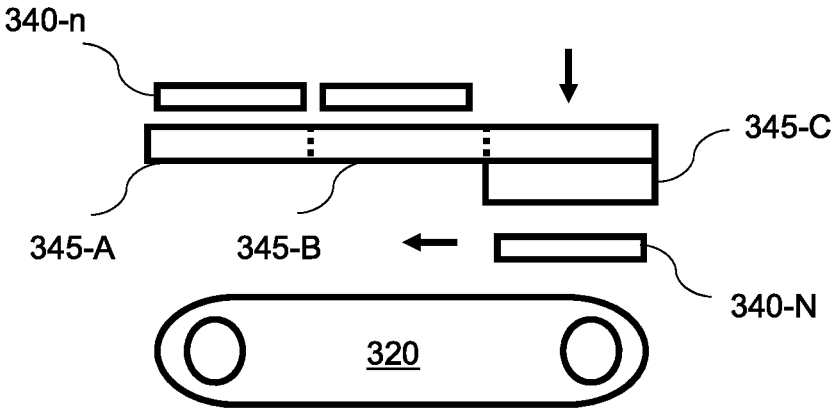
FIG. 3C is a schematic diagram showing a side view of a variation of the media transport apparatus of FIG. 3A at a second time.

FIGS. 3A, B and C show a variation of the apparatus of FIG. 1A-C or 2 that may be used to handle smaller sheets of print media. FIG. 3A shows features that are variations on the features shown in FIG. 1A, and FIG. 3B shows features that are variations on the features shown in FIG. 1C. FIG. 3C shows a further variation of the features shown in FIG. 1B.

FIG. 3A shows a media transport apparatus 300 that again comprises a first media transport section 310, a second media transport section 320 and a holding section 330. In this case, however, the media transport apparatus 300 receives a number of small sheets of print media. In this case, 'small' is taken to mean that the sheets have a width and/or height that is a proportion of the length of the media transport sections 110, 120 and the holding section 130. For example, in FIGS. 3A-C, the sheets of print media 340-*n* are about a third of the length of the media transport sections 110, 120 and the holding section 130. In certain implementations, 'small' sheets may have widths of between 0.5-0.7 m.

In certain printing presses, each sheet may have a margin that does not contain printing fluid. For example, each sheet may have a 1 cm margin on each side. In FIG. 3A, there are a plurality of guide elements 325 located above first media transport section 310 and the holding section 330, wherein the sheets of print media 340 are guided between the plurality of guide elements 325 and each of the first media transport section 310 and the holding section 330. The plurality of guide elements 325 may be laterally adjustable such that they apply a downwards reactive force within the unprinted margins of each sheet. For example, in FIG. 3B there are two sets of laterally spaced guide members 325A-C and 325D-F that are respectively and approximately aligned with the laterally spaced supporting elements 335 A and B. These guide members may comprise metallic strips or rods.

Above the holding section 330, there are a number of gaps in the guide member for each side. Within these gaps are a series of media transport elements 315 that are arranged to move the sheets of print media along the holding section 330. These media transport elements 315 may comprise driven belts or rollers. They may be of a same type or a different type as the media transport sections 310 and 320. In FIG. 3A, it may be seen how these media transport elements 315 apply a force to the upper edges of a sheet of print media, in order to accommodate multiple sheets upon the holding section 330. The holding section 330 may comprise a low friction material or surface to allow the lower edge of the print media to slide along the holding section 330. In other examples, the holding section 330 may comprise the media transport elements 315 to move the sheets from below. The media transport elements 315 may be laterally adjustable together with the guide members, e.g. they may be moved as a single unit in certain implementations.

In the example of FIGS. 3A and 3B it can be seen how the holding section 330 may now accommodate three small sheets of print media instead of one. In one example, all three sheets may be released together when the holding section 330 is actuated. This structure enables the loading of a number of smaller size sheets above the supporting elements 335 of the holding section 330 and by that reduce the frequency of dropping the sheets of media and increase the media time delay.

FIG. 3C shows a further variation of the media transport apparatus 300 of FIGS. 3A and 3B. In this case, the holding section 330 is split into a number of portions 345 A-C that each may be selectively actuated to deposit a separate sheet of print media onto the media transport section 320. In FIG. 3C the holding section 330 is split into three portions; however, any number of portions may be arranged, depending on the sheets of print media that can be handled by the media transport apparatus. In FIG. 3C, each of the three sheets of print media may be deposited in turn, or the end portion may be actuated without the others and the remaining sheets driven along the holding section 330 by the media transport elements 315.

Figure 4:
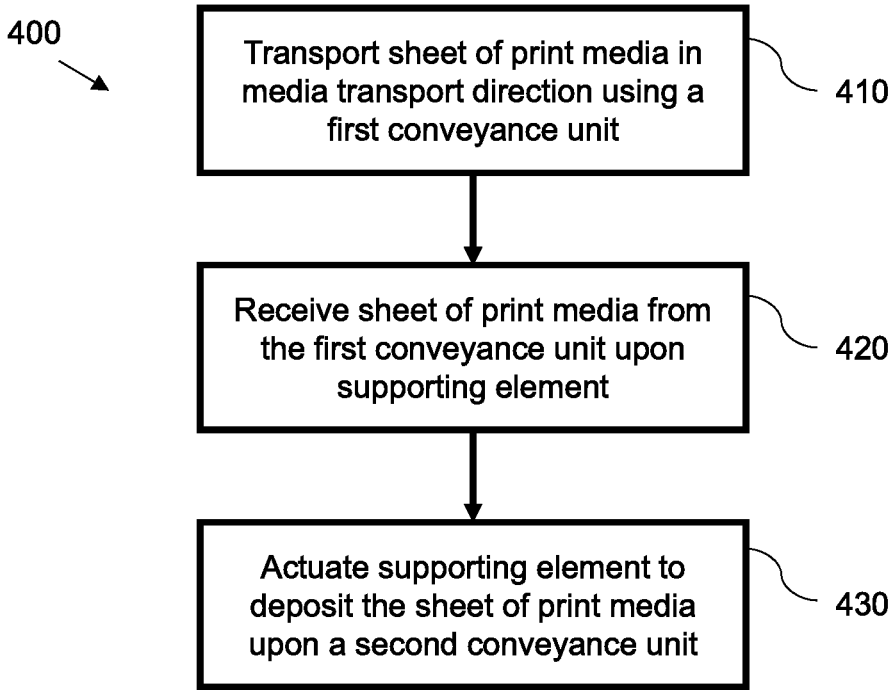
FIG. 4 is a flow diagram showing a method of delaying transport of a sheet of print media according to an example.

FIG. 4 shows an example method 400 of delaying transport of a sheet of print media, e.g. within a printing press or system. At block 410, the sheet of print media is transported in a media transport direction using a first conveyance unit, e.g. such as media transport sections 110, 210 or 310. This may be by way of a driven belt or roller system. At block 420, the sheet of print media from the first conveyance unit is received upon at least one supporting element, e.g. that may implement a holding section 130, 230 or 330. At block 430, the at least one supporting element is actuated so as to deposit the sheet of print media upon a second conveyance unit, e.g. such as media transport sections 120, 220 or 320. In this case, the time the sheet of print media is held on the supporting element, and drops onto the second conveyance unit, acts to introduce a time delay into the transport of print media that enables drying of printing fluid deposited upon the media.

In one example, the method is repeated a plurality of times before actuating at least one supporting element so as to deposit the sheet of print media upon an unloading conveyance unit. For example, this may be the case with the printing press 200 of FIG. 2.

In one example, receiving the sheet of print media from the first conveyance unit upon at least one supporting element comprises guiding the sheet of print media between a set of guide members and respective surfaces of the first conveyance unit and the at least one supporting element; and driving at least one media transport element aligned with the guide members above the at least one supporting element to move the sheet of print media along the at least one supporting element. For example, this is illustrated in FIG. 3A. In this case, a plurality of sheets of print media may be received from the first conveyance unit upon the at least one supporting element and portions of the at least one supporting element may be actuated to deposit one of the plurality of sheets of print media onto the second conveyance unit, wherein other ones of the plurality of sheets of print media are retained upon the at least one supporting element.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A media transport apparatus comprising:

a plurality of media transport tiers, each media transport tier including a media transport section and a holding section, the plurality of media transport tiers being vertically stacked;

wherein a direction of media transport is reversed for each media transport tier;

wherein the plurality of media transport tiers includes a first media transport tier and a second media transport tier;

wherein the first media transport tier has a first media transport section to transport a sheet of print media in a first media transport direction; and a first holding section horizontally spaced from and in horizontal alignment with the first media transport section and arranged to receive the sheet of print media from the first media transport section;

wherein the first holding section is moveable to drop the sheet of print media in freefall in a direction perpendicular to the first media transport direction to deposit the sheet of print media upon a second media transport section that is included in the second media transport tier;

wherein the first holding section comprises a plurality of laterally-spaced supporting elements that extend in the first media transport direction, wherein the sheet of print media is supported upon respective surfaces of the plurality of laterally-spaced supporting elements, wherein at least one of the plurality of laterally-spaced supporting elements is to rotate to enable the sheet of print media to drop in freefall in the direction perpendicular to the first media transport direction to deposit the sheet of print media upon the second media transport section, and wherein at least one of the plurality of laterally-spaced supporting elements is laterally moveable to accommodate different sizes of print media.

2. The media transport apparatus of claim 1, wherein:

the first holding section is spaced from the first media transport section in the first media transport direction, and the second media transport section is offset from the first media transport section in both the direction perpendicular to the first media transport direction and a direction parallel with the first media transport direction.

3. The media transport apparatus of claim 1, wherein each supporting element comprises a plurality of selectively actuatable portions.

4. The media transport apparatus of claim 1, comprising:

an unloading media transport section arranged below the last holding section in the plurality of media transport tiers.

5. The media transport apparatus of claim 1, comprising:

an air supply that directs an air flow onto the second media transport section.

6. A media transport apparatus comprising:

a plurality of media transport tiers, each media transport tier including a media transport section and a holding section, the plurality of media transport tiers being vertically stacked;

wherein a direction of media transport is reversed for each media transport tier;

wherein the plurality of media transport tiers includes a first media transport tier and a second media transport tier;

wherein the first media transport tier has a first media transport section to transport a sheet of print media in a first media transport direction; and a first holding section horizontally spaced from and in horizontal alignment with the first media transport section and arranged to receive the sheet of print media from the first media transport section;

wherein the first holding section is moveable to drop the sheet of print media in freefall in a direction perpendicular to the first media transport direction to deposit the sheet of print media upon a second media transport section that is included in the second media transport tier; and a plurality of guide elements located above the first media transport section and the first holding section, wherein the sheet of print media is guided between the plurality of guide elements and each of the first media transport section and the first holding section.

7. A media transport apparatus comprising:

a plurality of media transport tiers, each media transport tier including a media transport section and a holding section, the plurality of media transport tiers being vertically stacked;

wherein a direction of media transport is reversed for each media transport tier;

wherein the plurality of media transport tiers includes a first media transport tier and a second media transport tier;

wherein the first media transport tier has a first media transport section to transport a sheet of print media in a first media transport direction; and a first holding section horizontally spaced from and in horizontal alignment with the first media transport section and arranged to receive the sheet of print media from the first media transport section;

wherein the first holding section is moveable to drop the sheet of print media in freefall in a direction perpendicular to the first media transport direction to deposit the sheet of print media upon a second media transport section that is included in the second media transport tier; and at least one media transport element arranged above the first holding section to move the sheet of print media along the first holding section.

* * * * *